US006511069B1

(12) United States Patent
Nurse

(10) Patent No.: US 6,511,069 B1
(45) Date of Patent: Jan. 28, 2003

(54) BASEBALL TRIVIA GAME

(76) Inventor: Ammie L. Nurse, 42 Slinn Ave., Spring Valley, NY (US) 10977

( * ) Notice: Subject to any disclaimer, the term of this patent is extended or adjusted under 35 U.S.C. 154(b) by 0 days.

(21) Appl. No.: 09/904,723

(22) Filed: Jul. 13, 2001

(51) Int. Cl.[7] ..... A63F 3/00

(52) U.S. Cl. ..... 273/244.2; 273/259; 273/277; 273/430; 273/431

(58) Field of Search ..... 273/242, 243, 273/244, 244.1, 244.2, 247, 259, 277

(56) References Cited

U.S. PATENT DOCUMENTS 1,635,734 A * 7/1927 Ziegler ..... 273/249
4,000,897 A * 1/1977 York ..... 273/244
4,029,320 A * 6/1977 Hausman ..... 273/249
4,210,335 A * 7/1980 Licciardi ..... 273/238
4,273,337 A * 6/1981 Carrera et al. ..... 273/243
4,486,022 A * 12/1984 Dixon ..... 273/244
4,687,199 A * 8/1987 Aguirregomezcorta .. 273/145 C
4,856,780 A 8/1989 Begley et al.
4,907,808 A 3/1990 Turner et al.
5,186,467 A 2/1993 Chasin
D340,746 S 10/1993 Breen et al.
5,660,389 A 8/1997 Freda
5,762,337 A * 6/1998 Poisson ..... 273/244.2
5,884,914 A 3/1999 Lilien
6,267,376 B1 * 7/2001 Jenkins

* cited by examiner

*Primary Examiner*—Benjamin H. Layno
*Assistant Examiner*—Vishu K Mendiratta

(57) ABSTRACT

A baseball trivia game for learning baseball trivia. The baseball trivia game includes a game board having a top surface having a generally rectangular shape. The top surface has a game path thereon including a plurality of game spaces. The game path generally resembles a baseball diamond. A plurality of game pieces is provided. Each of plurality of trivia cards has a first side and second side. Each of the first sides has a different baseball trivia question thereon, and each of the second sides has an answer thereon relating to the trivia question on a respective the first side. The players answer in turn one of the trivia questions and moves their respective game pieces the number of game spaces indicated by the movement indicia if the player answers the trivia question correctly and wins by moving their game piece completely around the game path.

6 Claims, 7 Drawing Sheets

BASEBALL TRIVIA GAME

BACKGROUND OF THE INVENTION

1. Field of the Invention

The present invention relates to trivia games and more particularly pertains to a new baseball trivia game for learning baseball trivia.

2. Description of the Prior Art

The use of trivia games is known in the prior art. More specifically, trivia games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,884,914; 4,856,780; 5,186,467; 4,907,808; U.S. Pat. No. Des. 340,746; and U.S. Pat. No. 5,660,389.

While these devices fulfill their respective, particular objectives and requirements, the aforementioned patents do not disclose a new baseball trivia game. The inventive device includes a game board having a top surface having a generally rectangular shape. The top surface has a game path thereon including a plurality of game spaces. The game path generally resembles a baseball diamond and has a beginning space representing home plate. A plurality of game pieces is provided. Each of plurality of trivia cards has a first side and second side. Each of the first sides has a different baseball trivia question thereon, and each of the second sides has an answer thereon relating to the trivia question on a respective the first side. The questions are either regular questions or slam questions. The first sides have game space movement indicia thereon ranging from 1 to 9 for regular questions and greater than 10 for slam questions. The players answer in turn one of the trivia questions and moves their respective game pieces the number of game spaces indicated by the movement indicia if the player answers the trivia question correctly. The player wins the game by moving their game piece completely around the game path.

In these respects, the baseball trivia game according to the present invention substantially departs from the conventional concepts and designs of the prior art, and in so doing provides an apparatus primarily developed for the purpose of learning baseball trivia.

SUMMARY OF THE INVENTION

In view of the foregoing disadvantages inherent in the known types of trivia games now present in the prior art, the present invention provides a new baseball trivia game construction wherein the same can be utilized for learning baseball trivia.

The general purpose of the present invention, which will be described subsequently in greater detail, is to provide a new baseball trivia game apparatus and method which has many of the advantages of the trivia games mentioned heretofore and many novel features that result in a new baseball trivia game which is not anticipated, rendered obvious, suggested, or even implied by any of the prior art trivia games, either alone or in any combination thereof.

To attain this, the present invention generally comprises a game board having a top surface having a generally rectangular shape. The top surface has a game path thereon including a plurality of game spaces. The game path generally resembles a baseball diamond and has a beginning space representing home plate. A plurality of game pieces is provided. Each of plurality of trivia cards has a first side and second side. Each of the first sides has a different baseball trivia question thereon, and each of the second sides has an answer thereon relating to the trivia question on a respective the first side. The questions are either regular questions or slam questions. The first sides have game space movement indicia thereon ranging from 1 to 9 for regular questions and greater than 10 for slam questions. The players answer in turn one of the trivia questions and moves their respective game pieces the number of game spaces indicated by the movement indicia if the player answers the trivia question correctly. The player wins the game by moving their game piece completely around the game path.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baseball trivia game apparatus and method which has many of the advantages of the trivia games mentioned heretofore and many novel features that result in a new baseball trivia game which is not anticipated, rendered obvious, suggested, or even implied by any of the prior art trivia games, either alone or in any combination thereof.

It is another object of the present invention to provide a new baseball trivia game which may be easily and efficiently manufactured and marketed.

It is a further object of the present invention to provide a new baseball trivia game which is of a durable and reliable construction.

An even further object of the present invention is to provide a new baseball trivia game which is susceptible of a low cost of manufacture with regard to both materials and labor, and which accordingly is then susceptible of low prices of sale to the consuming public, thereby making such baseball trivia game economically available to the buying public.

Still yet another object of the present invention is to provide a new baseball trivia game which provides in the apparatuses and methods of the prior art some of the advantages thereof, while simultaneously overcoming some of the disadvantages normally associated therewith.

Still another object of the present invention is to provide a new baseball trivia game for learning baseball trivia.

Yet another object of the present invention is to provide a new baseball trivia game which includes a game board having a top surface having a generally rectangular shape. The top surface has a game path thereon including a plurality of game spaces. The game path generally resembles a baseball diamond and has a beginning space representing home plate. A plurality of game pieces is provided. Each of plurality of trivia cards has a first side and second side. Each of the first sides has a different baseball trivia question thereon, and each of the second sides has an answer thereon relating to the trivia question on a respective the first side. The questions are either regular questions or slam questions. The first sides have game space movement indicia thereon ranging from 1 to 9 for regular questions and greater than 10 for slam questions. The players answer in turn one of the trivia questions and moves their respective game pieces the number of game spaces indicated by the movement indicia if the player answers the trivia question correctly. The player wins the game by moving their game piece completely around the game path.

Still yet another object of the present invention is to provide a new baseball trivia game that provides a trivia game which eliminates players who do not have correct answers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
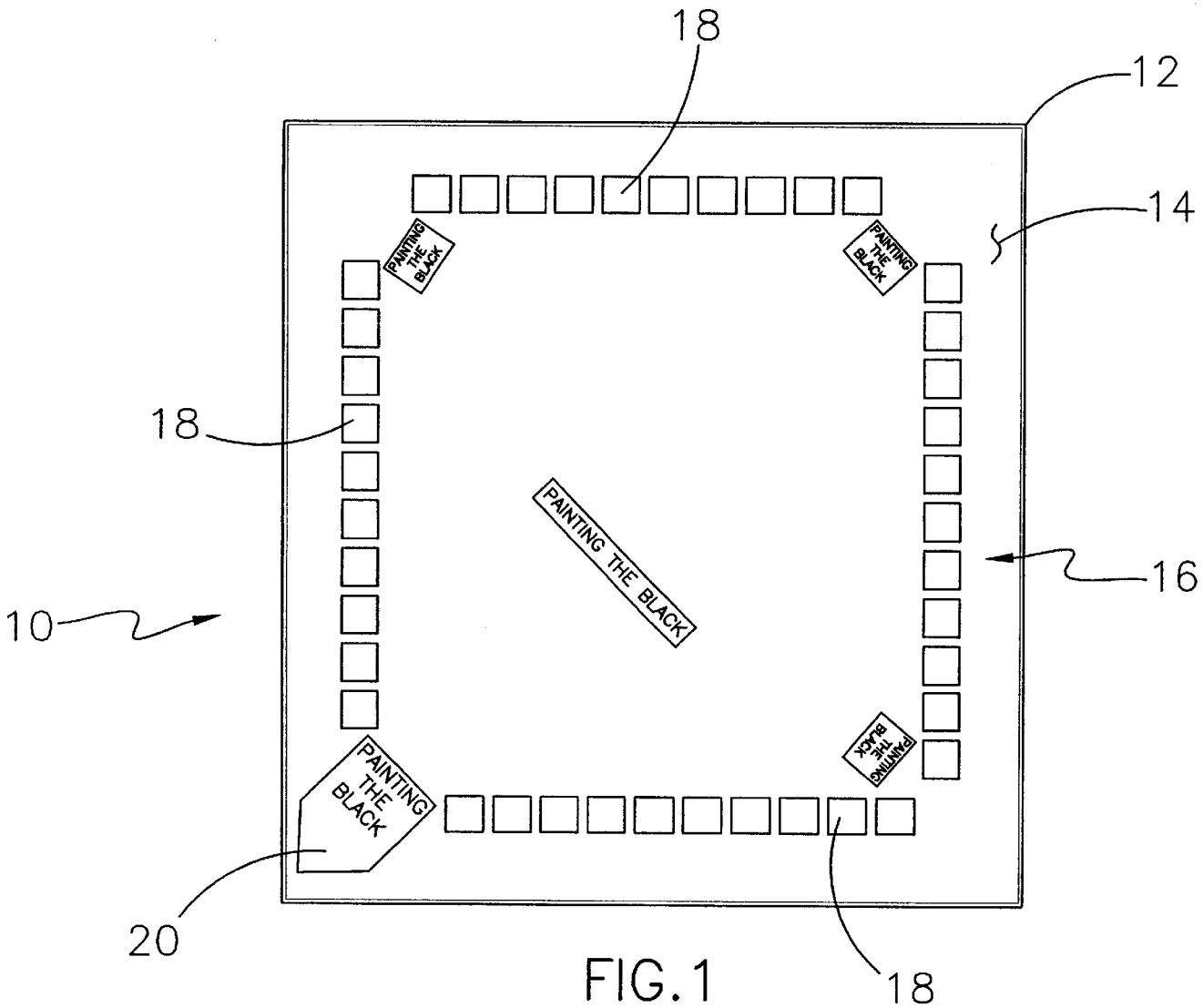
FIG. 1 is a schematic top view of the game board of a new baseball trivia game according to the present invention.
Figure 2:
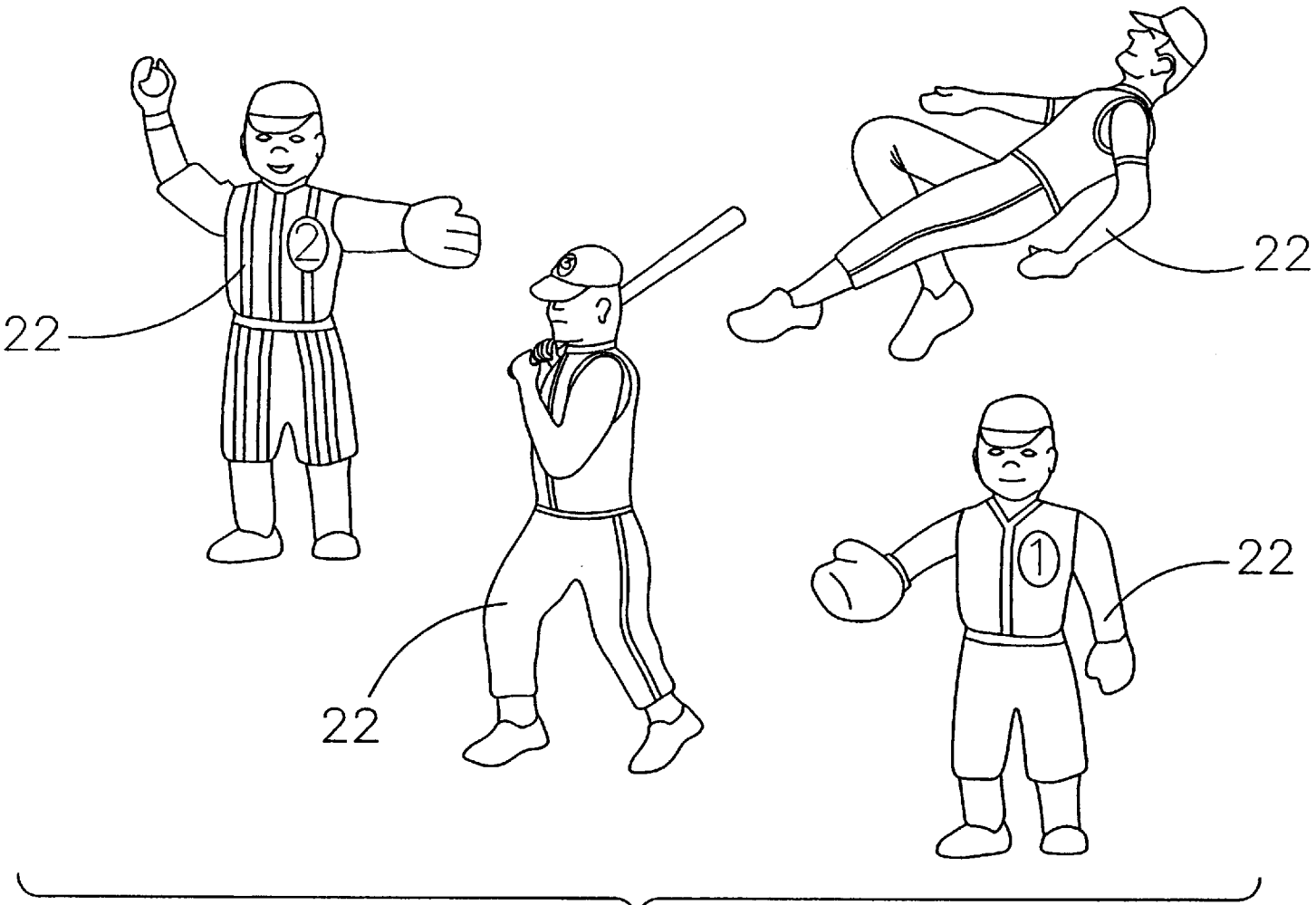
FIG. 2 is a schematic side view game pieces of the present invention.
Figure 3:
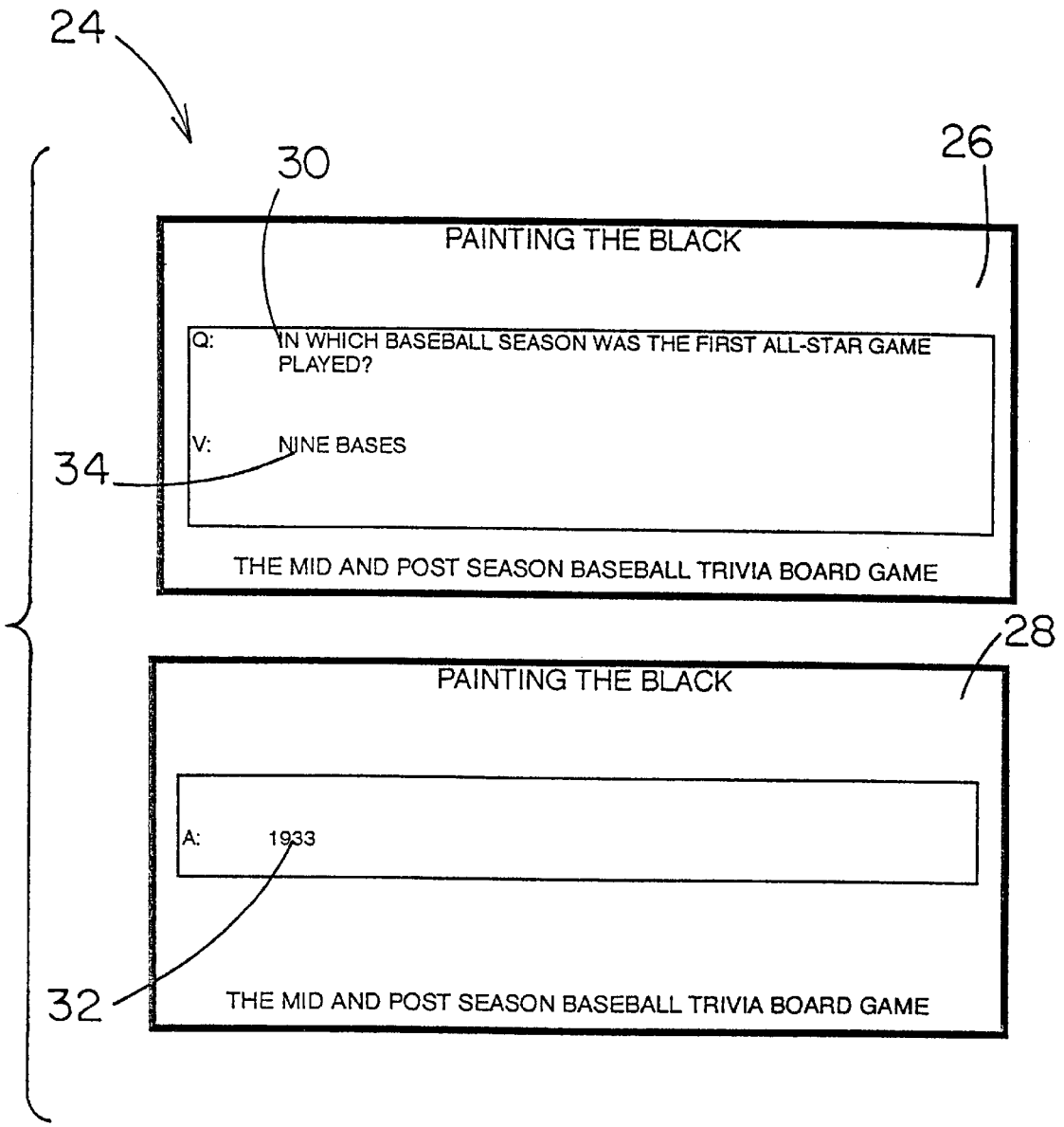
FIG. 3 is a schematic front and back view of a trivia card of the present invention.
Figure 4:
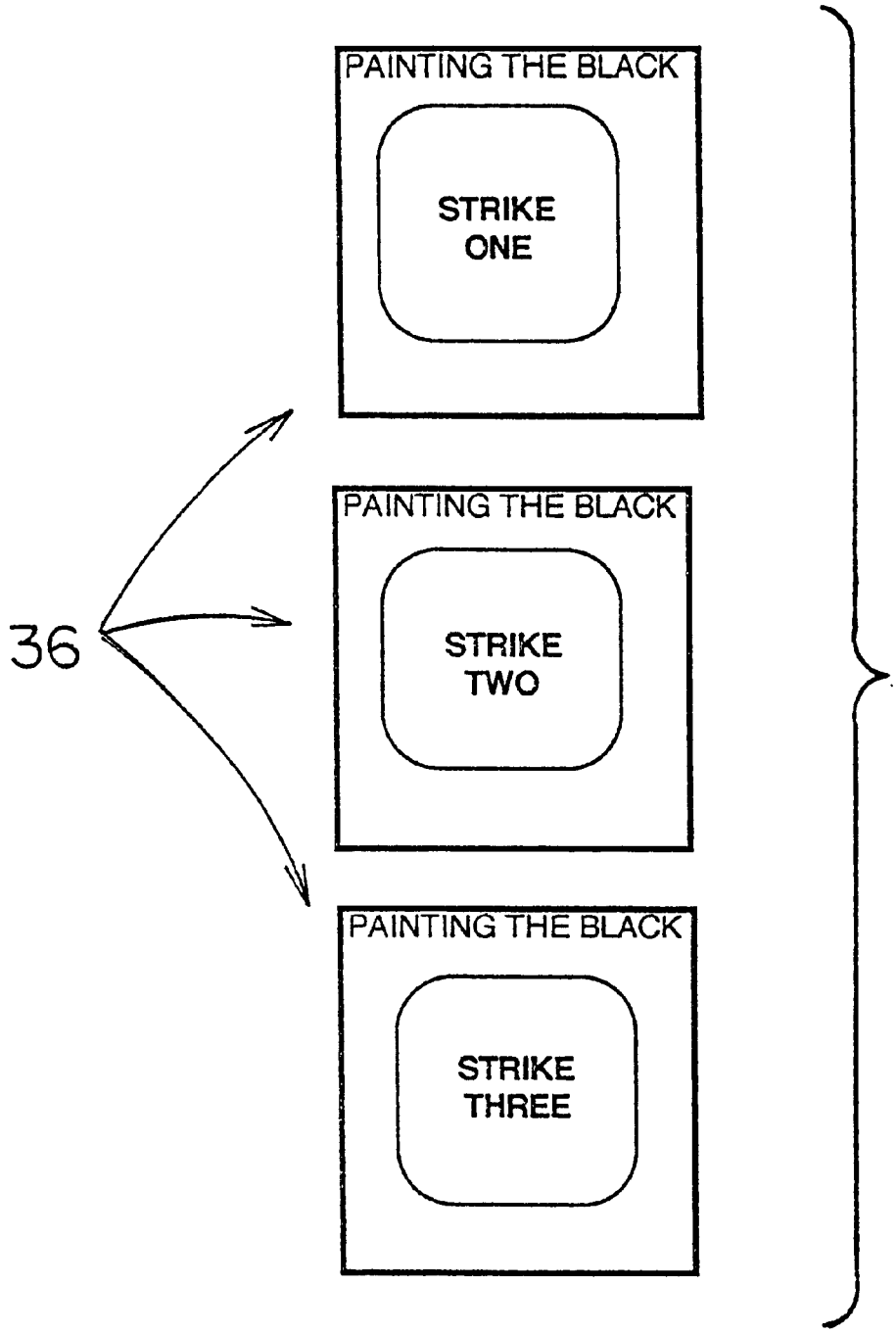
FIG. 4 is a schematic front view of the strike cards of the present invention.
Figure 5:
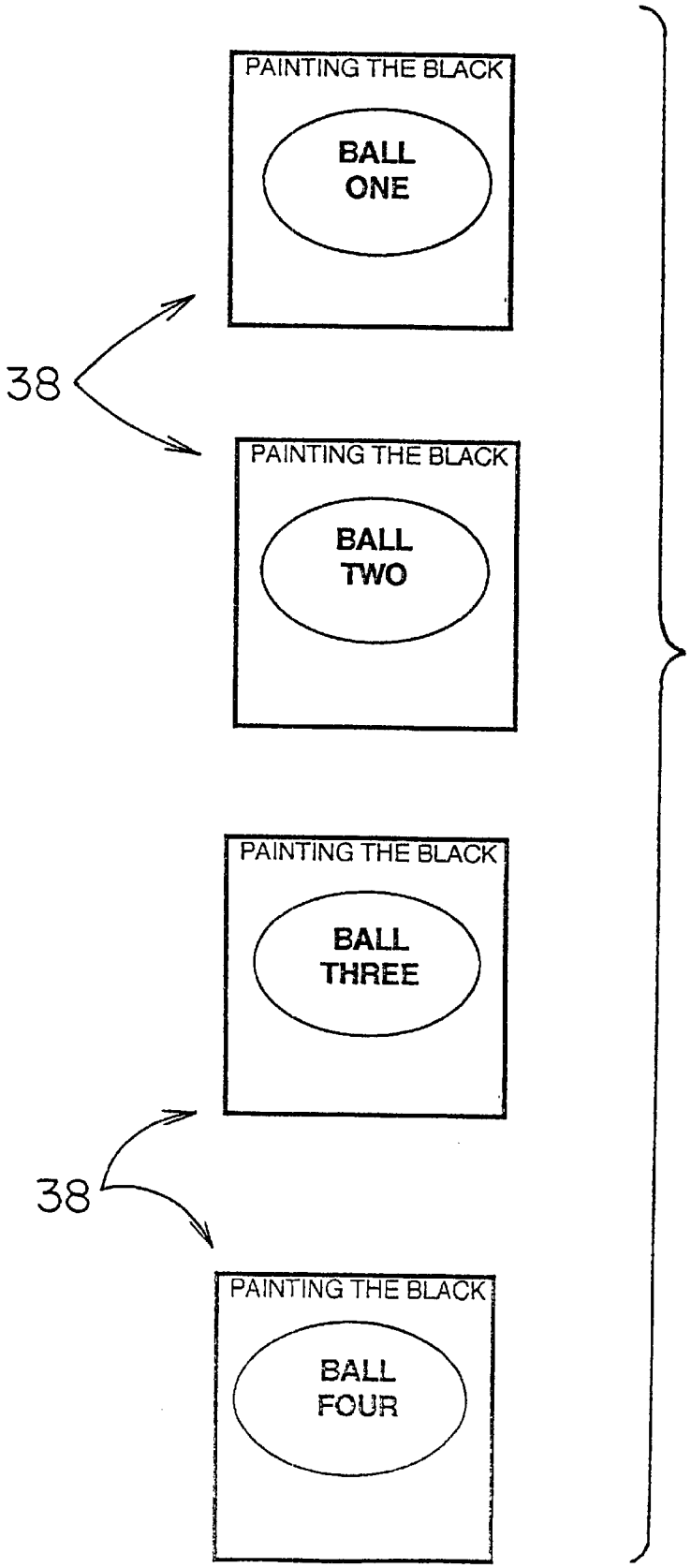
FIG. 5 is a schematic front view of the ball cards of the present invention.
Figure 6:
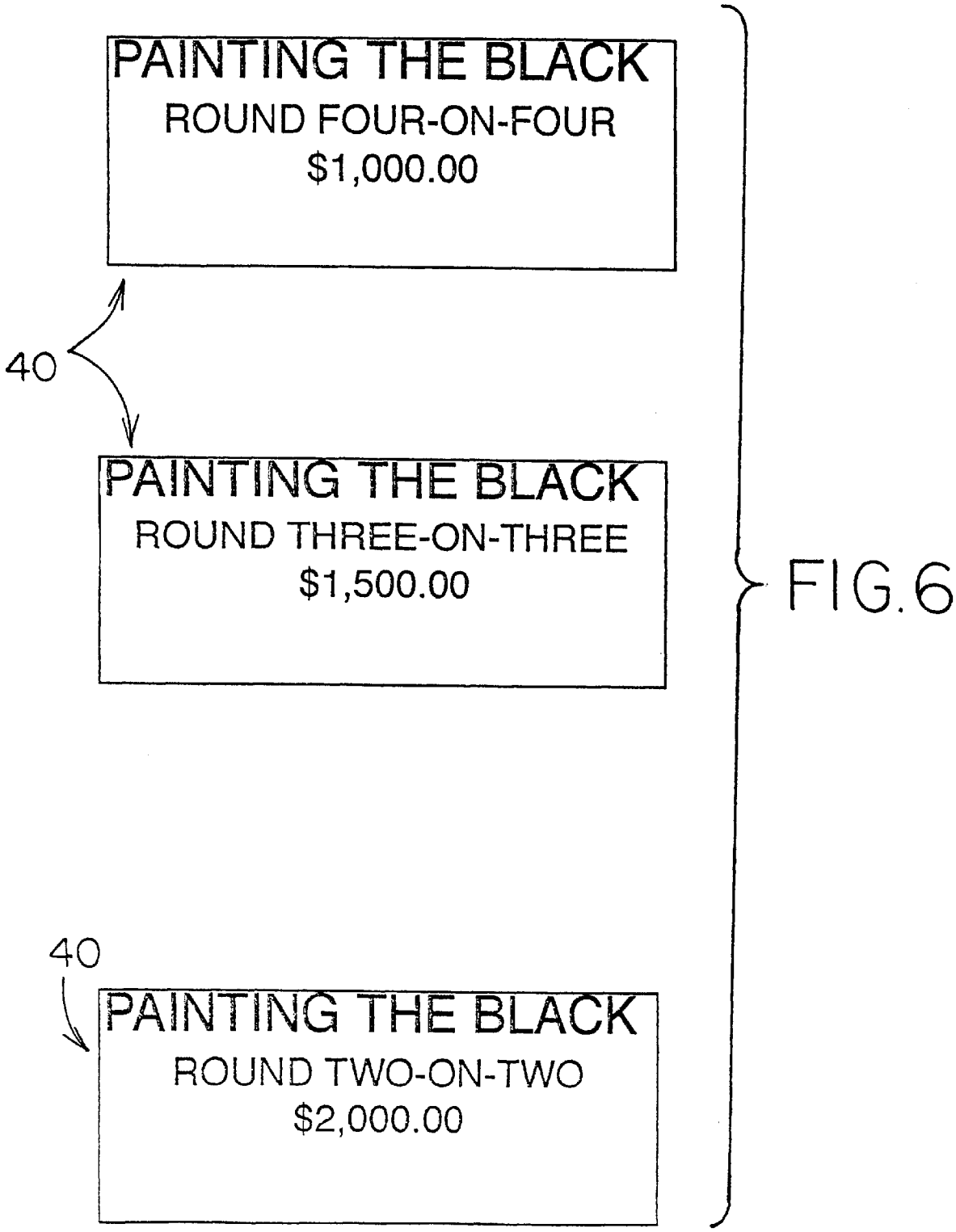
FIG. 6 is a schematic front view of the point cards of the present invention.
Figure 7:
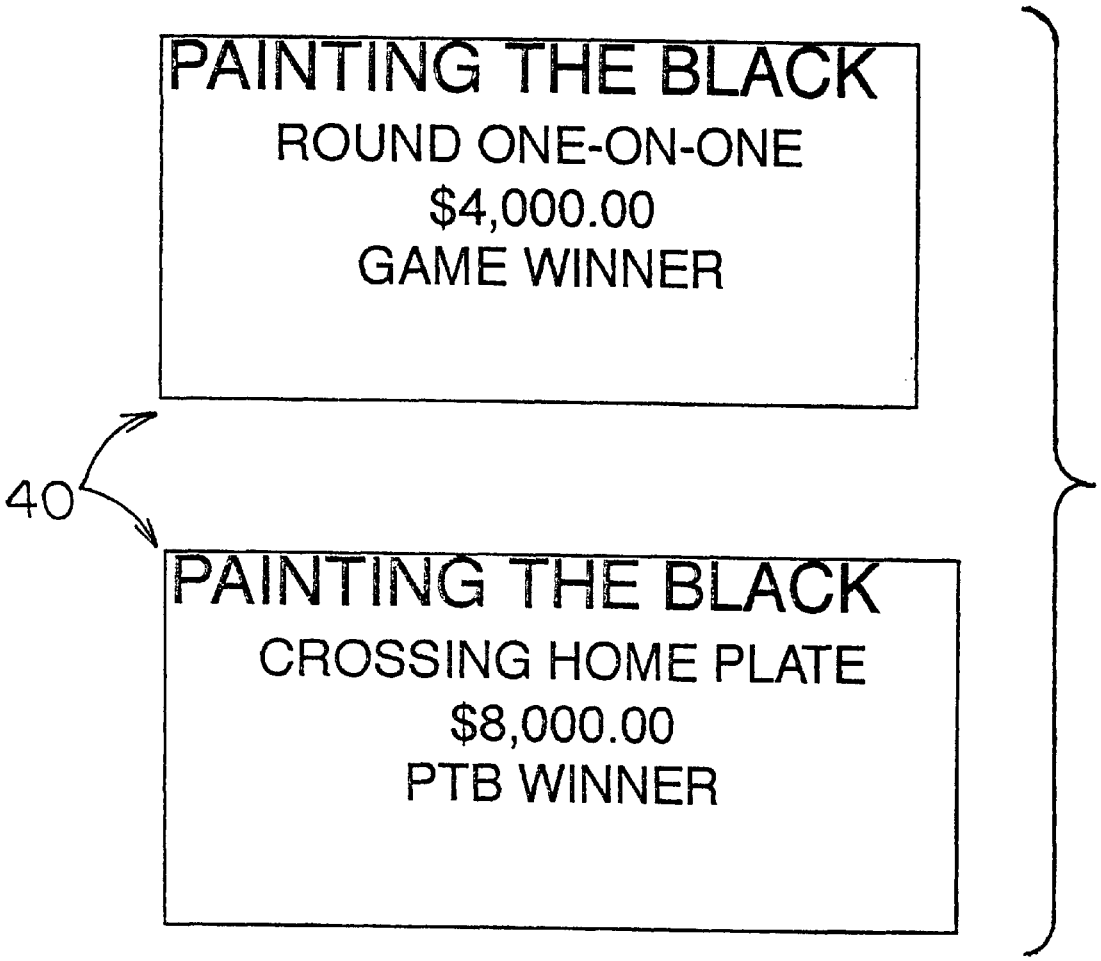
FIG. 7 is a schematic front view of the point cards the present invention.

With reference now to the drawings, and in particular to FIGS. 1 through 7 thereof, a new baseball trivia game embodying the principles and concepts of the present invention and generally designated by the reference numeral 10 will be described.

As best illustrated in FIGS. 1 through 7, the baseball trivia game 10 generally includes a game board 12 having a top surface 14 having a generally rectangular shape. The top surface 14 has a game path thereon 16 including a plurality of game spaces 18. The game path 16 generally resembles a baseball diamond and has a beginning space 20 representing home plate. Ideally, each of the game spaces 18 resembles a team logo from either a past or present major league baseball team.

Each of a plurality of game pieces 22 preferably resembles a baseball player in a stance selected from the group consisting of batting, throwing, catching and sliding.

Each of a plurality of trivia cards 24 has a first side 26 and second side 28. Each of the first sides 26 has a different baseball trivia question 30 thereon. The trivia questions are divided between regular questions and slam questions. Each of the second sides 28 has an answer 32 thereon relating to the trivia question 30 on a respective the first side 26. The questions may be selected from any trivia fact from major league professional baseball back through the year 1903 and including baseball teams which are no longer represented in professional baseball. Each of the first sides 26 has game space movement indicia 34 thereon. The regular questions have space movement indicia ranging from 1 to 9. The slam questions have movement indicia greater than 10. The slam questions are relatively harder than the regular questions.

The game 10 includes a plurality of strike cards 36 having strike one, strike two or strike three indicia thereon and a plurality of ball cards 38 having ball one, ball two, ball three or ball four indicia thereon.

A plurality of point cards 40 is used to keep track of player points. The point cards have point indicia thereon including 1000 points, 1500 points, 2000 points, 4000 points or 8000 points.

Rules of the Game

The game 10 is primarily made for four players, each of which selects one of the game pieces 22.

The game is played in a series of four rounds. A first round includes each of the players answering in turn one of nine of the trivia questions. A second round includes a remaining three players answering in turn one of seven of the trivia questions. A third round includes a remaining two the players answer in turn one of four of the trivia questions. A fourth round includes a remaining one of the players answering three of the trivia questions.

Each of the players moves their respective game piece 22 the number of game spaces indicated by the movement indicia indicated on the trivia card if the player correctly answers the question on the trivia card. If the player completes the game path on a slam question, that player wins the game and receives an 8000 point card.

A player selects one of the strike cards 36 in consecutive order if the player answers the trivia question incorrectly. A player selects one of the ball cards 38 in consecutive order by the player partially answering incorrectly one of the trivia questions has multiple questions therein and moves their game piece one game space when the player has accumulated enough ball cards to select ball four. At the beginning of each round, each player discards any held strike 36 or ball 38 cards from the previous round.

A player is disqualified and the remaining players move onto the next consecutive round when that player selects strike three or partially answers incorrectly one of the trivia questions after selecting ball four. A first disqualified player receives a 1000 point card, a second disqualified player receives a 1500 point card, a third disqualified player receives a 2000 point card and the remaining one of the players wins the game and receives the 4000 point card. The one remaining player plays the round four by themselves and receives the 8000 point card if that remaining player is able to cross the starting space in round four. During any round of the game, any of the players still playing may win the game and receive an 8000 point card by moving their game piece completely around the game path to the beginning space. This may be done with the accumulation of movements of their game piece through the rounds. The players may continue the game beginning at round 1 in order to accumulate additional points.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a trivia game comprising the steps of:

providing a game board having a top surface having a generally rectangular shape, said top surface having a game path thereon including a plurality of game spaces, said game path generally resembling a baseball diamond and having a beginning space representing home plate;

providing a plurality of game pieces;

providing a plurality of trivia cards, each of said first sides having a different baseball trivia question thereon, said trivia questions being selected from the group consisting of regular questions and slam questions, each of said second sides having an answer thereon relating to said trivia question on a respective said first side, each of said first sides of said regular questions having game space movement indicia indicating 1 through 9, each of said first sides of said slam questions having game space movement indicia indicating 10 or greater;

selecting four players;

selecting a game piece by one of each of said players; and answering in turn one of said trivia questions by one of said players;

moving said respective game piece the number of game spaces indicated by said movement indicia if the player answers the trivia question correctly;

repeating the answering of one of said trivia questions and moving said respective game piece for each of the remaining players;

wherein a player wins the game by moving their game piece around the game path;

providing a plurality of strike cards, each one of said strike cards having an indicia, said indicia being strike one, strike two or strike three;

selecting one of said strike cards in consecutive order by the player who previously answered the trivia question incorrectly; and disqualifying a player from the game if said player selects said strike three.

2. The method of playing a trivia game as in claim 1, further including the steps of:

providing a plurality of ball cards, each one of said ball cards having an indicia thereon, said indicia being ball one, ball two, ball three or ball four;

selecting one of the ball cards in consecutive order by the player who previously partially answered incorrectly one of said trivia questions having multiple questions therein;

moving a game piece one game space when said player selects ball four; and disqualifying a player and moving when that player partially answers incorrectly one of said trivia questions after selecting ball four.

3. The method of playing a trivia game as in claim 1, providing a plurality of strike cards, each one of said strike cards having an indicia thereon, said indicia being strike one, strike two or strike three;

providing a plurality of point cards having point indicia thereon, said point indicia including 1000 points, 1500 points, 2000 points, 4000 points or 8000 points;

providing a first round wherein each of said players answer in turn one of nine of said trivia questions;

providing a second round wherein a remaining three of said players answer in turn one of seven of said trivia questions;

providing a third round wherein a remaining two of said players answer in turn one of four of said trivia questions;

providing a fourth round wherein each of a remaining one of said players answer in turn one of three of said trivia questions;

said receiving one of said 8000 point cards when said movement indicia indicates slam if said player correctly answers said trivia question and said player has moved their game piece around the game path;

selecting one of said strike cards in consecutive order by the player answering the trivia question incorrectly;

disqualifying a player and moving onto the next consecutive round when that player selects strike three, a first disqualified player receiving said 1000 point card, a second disqualified player receiving said 1500 point card, a third disqualified player receiving said 2000 point card and said remaining one of said players winning the game and receiving said 4000 point card;

wherein said one remaining player plays said round four and receives said 8000 point card if said remaining player crosses said starting space in round four.

4. The method of playing a trivia game as in claim 1, wherein each of said game pieces resembles a baseball player.

5. A method of playing a trivia game comprising the steps of:

providing a game board having a top surface having a generally rectangular shape, said top surface having a game path thereon including a plurality of game spaces, said game path generally resembling a baseball diamond and having a beginning space representing home plate;

providing a plurality of game pieces, each of said game pieces resembling a baseball player in a stance selected from the group consisting of batting, throwing, catching and sliding;

providing a plurality of trivia cards, each of said trivia cards having a first side and second side, each of said first sides having a different baseball trivia question thereon, said trivia questions being selected from the group consisting of regular questions and slam questions, each of said second sides having an answer thereon relating to said trivia question on a respective said first side, each of said first sides of said regular questions having game space movement indicia indicating 1 through 9, each of said first sides of said slam questions having game space movement indicia indicating 10 or greater;

providing a plurality of strike cards having strike one, strike two or strike three indicia thereon;

providing a plurality of ball cards having ball one, ball two, ball three or ball four indicia thereon;

providing a plurality of point cards having point indicia thereon, said point indicia including 1000 points, 1500 points, 2000 points, 4000 points or 8000 points;

providing four players;

selecting one of said game pieces by each of said players;

providing a first round wherein each of said players answer in turn one of nine of said trivia questions;

providing a second round wherein a remaining three of said players answer in turn one of seven of said trivia questions;

providing a third round wherein a remaining two of said players answer in turn one of four of said trivia questions;

providing a fourth round wherein a remaining one of said players answer in turn one of three of said trivia questions;

moving their respective game piece the number of game spaces indicated by said movement indicia if the player answers the trivia question correctly, said player moving the game piece completely around the game path, receiving one of said 8000 point cards and winning the game if said player has completed moving their game piece around the board if the answered trivia question was a slam question;

selecting one of said strike cards in consecutive order by the player answering the trivia question incorrectly;

selecting one of the ball cards in consecutive order by the player partially answering incorrectly one of said trivia questions having multiple questions therein and moving a game piece one game space when said player selects ball four;

disqualifying a player and moving onto the next consecutive round when that player selects strike three or partially answers incorrectly one of said trivia questions after selecting ball four, wherein each player discards any strike cards and ball cards from a previous round, a first disqualified player receiving said 1000 point card, a second disqualified player receiving said 1500 point card, a third disqualified player receiving said 2000 point card and said remaining one of said players winning the game and receiving said 4000 point card, wherein said one remaining player plays said round four and receives said 8000 point card if said remaining player crosses said starting space in round four, wherein any of the players may win the game and receive the 8000 point card by moving their game piece completely around the game path to the beginning space;

wherein said game may be replayed such that said players accumulate additional points.

6. A trivia game comprising:

a game board having a top surface having a generally rectangular shape, said top surface having a game path thereon including a plurality of game spaces, said game path generally resembling a baseball diamond and having a beginning space representing home plate;

a plurality of game pieces;

a plurality of trivia cards, each of said trivia cards having a first side and second side, each of said first sides having a different baseball trivia question thereon, said trivia questions being selected from the group consisting of regular questions and slam questions, each of said second sides having an answer thereon relating to said trivia question on a respective said first side, each of said first sides of said regular questions having game space movement indicia indicating 1 through 9, each of said first sides of said slam questions having game space movement indicia indicating 10 or greater;

a plurality of strike cards having strike one, strike two or strike three indicia thereon;

a plurality of ball cards having ball one, ball two, ball three or ball four indicia thereon;

a plurality of point cards having point indicia thereon, said point indicia including 1000 points, 1500 points, 2000 points, 4000 points or 8000 points.

* * * * *